US011629501B1

(12) United States Patent
Yari et al.

(10) Patent No.: US 11,629,501 B1
(45) Date of Patent: Apr. 18, 2023

(54) MODULAR CONSTRUCTION CONNECTION MECHANISM

(71) Applicant: Prefabricated Design Systems, LLC, Los Angeles, CA (US)

(72) Inventors: Paul Yari, Los Angeles, CA (US); Hooshang Kaen, Los Angeles, CA (US); James Kaen, San Diego, CA (US); Edward Kaen, Los Angeles, CA (US); Steven Yari, Los Angeles, CA (US)

(73) Assignee: Prefabricated Design Systems, LLC, Los Angeles, CA (US)

( * ) Notice: Subject to any disclaimer, the term of this patent is extended or adjusted under 35 U.S.C. 154(b) by 0 days.

(21) Appl. No.: 17/664,016

(22) Filed: May 18, 2022

(51) Int. Cl.
*E04B 1/18* (2006.01)
*E04F 11/035* (2006.01)
*E04G 13/06* (2006.01)

(52) U.S. Cl.
CPC ..... *E04F 11/035* (2013.01); *E04B 1/18* (2013.01); *E04G 13/062* (2013.01)

(58) Field of Classification Search
CPC ..... E04B 2001/2676; E04B 2001/2692; E04B 2001/3577; E04B 2001/3583; E04B 2001/2415; E04B 2001/2418; E04B 2001/2421; E04B 2001/2484; E04B 2001/2405; E04B 2001/1924; E04B 2001/1957; E04B 2005/232; E04B 2005/237; E04B 5/02; E04B 5/023; E04B 5/26; E04B 5/263; E04B 5/265; E04B 1/348; E04B 1/34807; E04B 1/35; E04B 1/18; E04B 1/185; E04B 1/1903; E04B 1/1912; E04H 1/00; E04H 1/005; E04H 1/02; E04H 1/04
See application file for complete search history.

(56) References Cited

U.S. PATENT DOCUMENTS

| | | | | |
|---|---|---|---|---|
| 3,820,293 | A * | 6/1974 | Ohe et al. | E04B 2/707 52/223.7 |
| 4,697,398 | A * | 10/1987 | Granieri | E04H 9/02 52/236.8 |
| 5,031,371 | A * | 7/1991 | Davister | E04B 1/1909 52/236.1 |
| 5,342,138 | A * | 8/1994 | Saito | E04H 12/2261 403/189 |
| 7,762,030 | B2 * | 7/2010 | Espinosa | E02D 27/34 52/223.13 |
| 9,222,251 | B2 * | 12/2015 | Espinosa | B28B 23/0056 |
| 10,011,984 | B2 * | 7/2018 | Verraes | E04B 1/40 |
| 10,480,178 | B2 * | 11/2019 | Espinosa | E04B 1/26 |
| 2004/0182016 | A1 * | 9/2004 | Locke | E04H 9/14 52/79.13 |

* cited by examiner

*Primary Examiner* — Jessica L Laux
(74) *Attorney, Agent, or Firm* — Knobbe Martens Olson & Bear LLP

(57) ABSTRACT

A system for securing modular building units to each other and a method for assembling structures using said method is disclosed. The disclosed system allows for modules to be connected to each other from an external position, without a person having to enter the modules to fasten components internally. The system and method may be used to build structures using prefabricated modules, avoiding significant amounts of onsite labor and drastically reducing the time required to erect structures.

11 Claims, 12 Drawing Sheets

MODULAR CONSTRUCTION CONNECTION MECHANISM

BACKGROUND

Field of the Disclosure

The present disclosure relates to systems and methods for connecting pre-fabricated building modules together. The disclosure also relates to systems and methods of constructing modular buildings and structures.

Description of the Related Art

As areas urbanize higher density and increased land cost make buildings a necessity. Higher density also provides higher value to communities and to the environment. It reduces resource use by limiting vehicle trips and reduces development footprints to leave more undisturbed natural land elsewhere in the city or outside of city limits.

The typical cost of construction for buildings is inflated by the cost of onsite labor, particularly when onsite labor-intensive tasks are performed higher and higher above ground level. As construction activities move up a tall building, labor rates increase and production becomes less efficient for a number of reasons including the necessity of moving project materials by crane or elevator to get the materials to their final installation location. At higher elevations, movement of both materials and labor slows down, increasing construction schedule times and again adding to the construction cost.

Unfortunately in many economic climates constructing a building has become unfeasible due to the high cost of building in general. Since income from building operations is solely reliant upon economic conditions, the only way to make this building type viable in many situations is to reduce the cost of construction.

SUMMARY

The systems and methods of the present disclosure have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of Certain Embodiments," one will understand how the features of this disclosure provide several advantages over other modular construction systems and methods.

One aspect is a system for securing a plurality of modules to each other. The system may comprise two or more horizontal support structures, one or more support rods, each having an upper end and lower end on opposite longitudinal poles of each rod. The system may also comprise one or more connecting nuts, each having openings on both longitudinal ends, and each having a flange which can be disposed circumferentially around a portion of the nut between both longitudinal ends. The system can also comprise a spacer having one or more holes disposed through it from an upper surface of the spacer through the lower surface of the spacer. The spacer may be sized and shaped to fit between the top of one of the horizontal support structures and the bottom of another horizontal support structure. The spacer and the horizontal support structures may be configured to receive the connecting nut such that one of the longitudinal ends of the connecting nut is disposed in one horizontal support structure while the other longitudinal end of the connecting nut is disposed in another horizontal support structure. Both the upper end and the lower end of the one or more support rods may be configured to attach to a connecting nut.

In some embodiments, the two or more horizontal support structures surround an upper edge and a lower edge of a module of the plurality of modules. In some embodiments, the module is a prefabricated module. In some embodiments, the prefabricated module is a prefabricated section of a building. In some embodiments, the module is an apartment.

In other embodiments, the module comprises one or more sets of stairs. In other embodiments, the module comprises one or more elevator shafts. In other embodiments, the module comprises a hallway. In other embodiments, the module comprises an apartment and a hallway. In other embodiments, the module comprises an apartment and a staircase.

Another aspect is a method for assembling buildings comprising placing a first building module on a foundation, the building module having a lower horizontal support structure attached to a bottom of the building module and an upper horizontal support structure attached to a top of the building module. The method may include connecting the lower horizontal support structure to the foundation by fastening a first connecting nut to the foundation from inside the lower horizontal support structure. The method may also include attaching a support rod to a top side of the first connecting nut such that the support rod runs vertically, perpendicular to the lower horizontal support structure. The method may also include connecting a spacer on top of the upper horizontal support structure, the spacer being sized and shaped to configured to fit between the top of one of the horizontal support structures and the bottom of another horizontal support structure. The method may also include placing a second building module on top of the first building module such that a lower horizontal support structure of the second building module rests on top of the spacer. The method may also include connecting the second building module to the first building module by fastening a second connecting nut to an upper end of the support rod.

In some embodiments, the first horizontal support structure is attached to and surrounding the bottom edge of the module and the second horizontal support structure is attached to and surrounding the top edge of the module. In some embodiments, the spacer connects to more than one horizontal support, corresponding to more than one building module.

Another aspect is a method for assembling buildings comprising placing a first floor, comprised of a plurality of building modules on a foundation. Each one of the plurality of modules may have at least one horizontal support attached on the lower end of the module and one horizontal support structure attached on the upper end of the module. The method may also include connecting the horizontal support structures attached on the lower end of each module to the foundation by fastening a connecting nut to the foundation from inside each of the horizontal support structures. The method may also include attaching a support rod to the top side of each of the connecting nuts, such that the support rods run vertically, perpendicular to the horizontal supports. The method may also include connecting a spacer on top of the horizontal support attached on the upper end of the module. The method may also include placing a second floor, comprised of a second plurality of building modules on top of the first floor of building modules, such that the horizontal supports attached on the lower end of each module in the second floor of building modules rests on top of the spacers connected to the top of the horizontal supports attached to the upper end of the first floor of building modules. The method may also include connecting the second floor of building module to the first floor of building module by fastening a second connecting nut to the upper end of each of the support rods.

BRIEF DESCRIPTION OF THE DRAWINGS

These and other features, aspects, and advantages of the invention disclosed herein are described below with reference to the drawings of some embodiments, which are intended to illustrate and not to limit the invention.

DETAILED DESCRIPTION

Although certain embodiments and examples are disclosed below, it will be understood by those in the art that the invention extends beyond the specifically disclosed embodiments and/or uses of the invention and obvious modifications and equivalents thereof. Thus, it is intended that the scope of the invention herein disclosed should not be limited by the particular disclosed embodiments described below.

Developments in modular, prefabricated construction techniques have greatly improved the speed and efficiency with which commercial apartment buildings can be constructed. Much of the construction cost can be reduced by prefabricating repeated sections of building called modules. These modules can be built in a factory or elsewhere completely off-site, away from the building site. Modules can be produced in an assembly-line fashion, greatly reducing the cost of producing a module when compared to building an equivalent portion of a building on site.

By fabricating building units, pieces of units, other parts of the building, and/or other modular components, constructions projects can save on labor and other costs associated with onsite construction. The prefabricated modules can be produced in a factory and then delivered to the intended site for assembly. Prefabricated sections are sometimes placed using a crane. The modules can be placed side-by-side, end-to-end, or stacked, allowing for a variety of configurations and styles. After placement, the modules are joined together using inter-module connections.

Advantageously, building modules constructed in a factory can be manufactured with improved tolerances and quality control measures as opposed to onsite work, where multiple parties (contractors, sub-contractors, etc.) may be involved in the creation of a building. Building modular units in a factory and assembling them on site in the manner described herein also reduces the impact on the environment as well as impact on the areas surrounding the building site by way of reduction to traffic, noise, and duration of the time required to erect buildings.

When commercial apartment or other buildings are constructed with prefabricated components, one challenge which must be addressed is how to connect modules or units to one another in a manner which maintains structural integrity as these buildings are scaled up. In typical methods of modular construction known in the art, a construction crew will have to enter the modules and weld or fasten portions of the modules in order to sufficiently secure the modules.

Described herein are embodiments of a connection system and mechanism that can be implemented in order to advantageously connect prefabricated modules, and/or other components of a building together. This system can allow for buildings to be constructed with building modules that can be connected from the outside, alleviating the need for workers to enter building units during construction.

Figure 1:
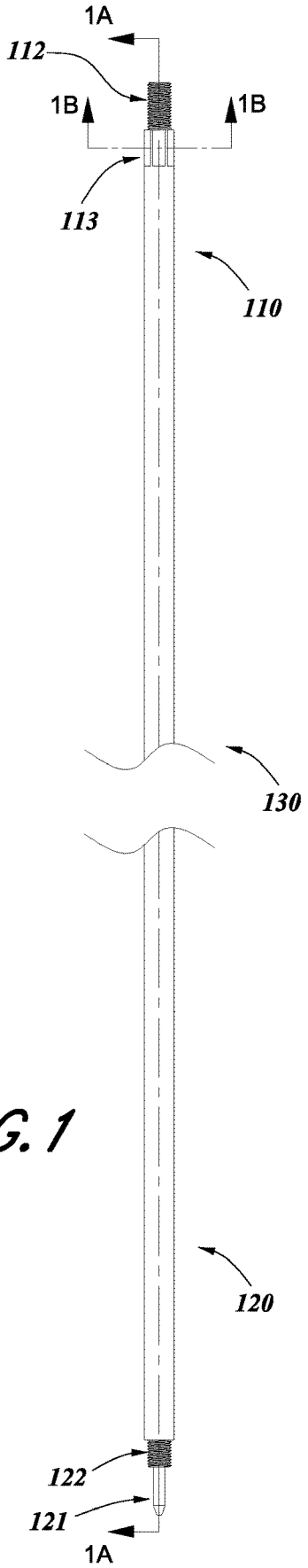
FIG. 1 is a side view of an embodiment of a support rod for use with a connection assembly as disclosed herein.
Figure 1A:
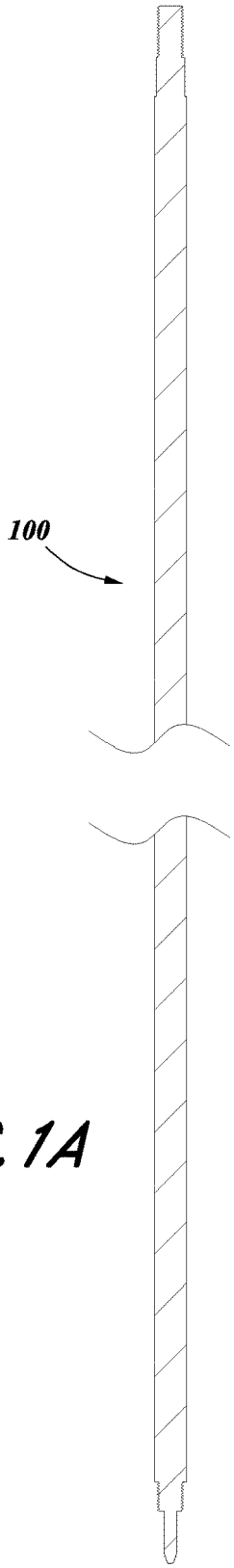
FIG. 1A is a side, cross-sectional view through the support rod of FIG. 1.

FIG. 1 is a side view of an embodiment of a support rod 100 for use with a connection assembly 400 as disclosed herein. FIG. 1A is a side, cross-sectional view through the support rod 100 of FIG. 1. In certain embodiments, the support rod 100 can be used to secure modules 500 together in the construction of a building. In certain embodiments, the support rod 100 comprises an upper end 110, a lower end 120, and a shaft portion 130 running between the upper and lower ends. In some embodiments, multiple support rods 100 can be connected to each other (via connecting nuts 200), end to end, to create one long rigid member. In some embodiments, the support rods 100 secure a vertical stack of building modules 500 or apartments to one another.

Figure 1B:
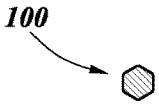
FIG. 1B is a cross-sectional view through the support rod of FIG. 1.

In some embodiments, the lower end 120 of the support rod 100 has a threaded portion 122 and a protrusion 121 which juts out from the end of the support rod 100. In some embodiments, the protrusion 121 can be cylindrical with a tapered end, capable of facilitating easier alignment and combination with the upper end 110 of a connecting nut 200 (described in more detail below) and/or a different support rod 100. In some embodiments, the upper end 110 of the support rod 100 can have a threaded portion 112 and/or a shaped portion 113. The threaded portion 112, 122 of both ends of the support rod 100 can be configured to attach to the connecting nut 200. In some embodiments, the shaped portion 113 can be a hexagonally shaped section of the support rod 100 which may provide a surface that enables a wrench or other tool to interface with in order to turn/tighten the support rod 100. FIG. 1B is a cross-sectional view through the support rod 100 of FIG. 1. In certain embodiments, a cross-section of the support rod 100 can have a hexagonal shape. Of course, the shape of the cross-section is not limited to being hexagonal and can have any other shape. For example, in certain embodiments, the shape is selected to match the shape of the tool intended to interface with the support rod 100. In some embodiments, the support rod 100 may have a locking collar, capable of being tightened to lock the support rod 100 in place. Additionally, in some embodiments the support rods 100 and connecting nuts 200 are attached to each other through a means other than threading. For example, in certain embodiments, the support rod 100 may not have a shaped portion 113 or threaded portions 112/122.

Figure 2B:
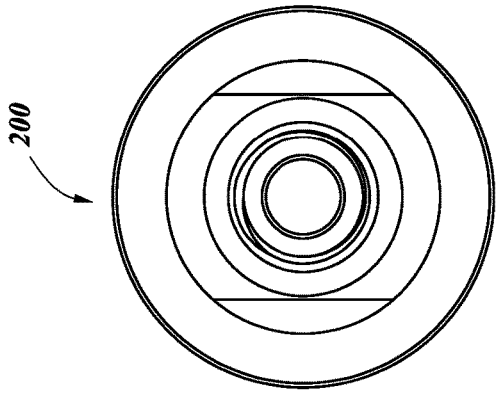
FIG. 2B is a top view of the connecting nut of FIG. 2.
Figure 2C:
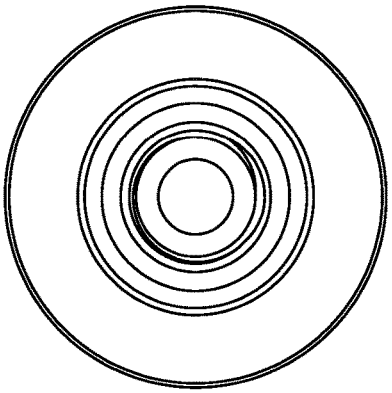
FIG. 2C is a bottom view of the connecting nut of FIG. 2.
Figure 2A:
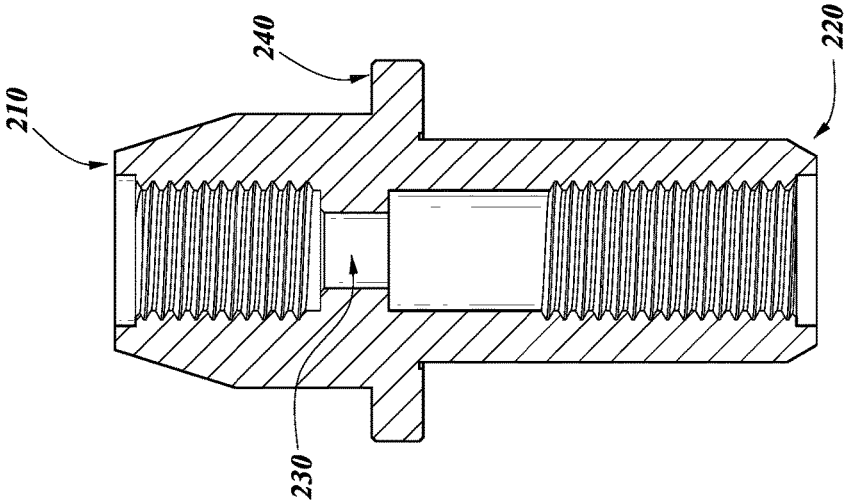
FIG. 2A is a cross-sectional view through the connecting nut of FIG. 2.
Figure 2:
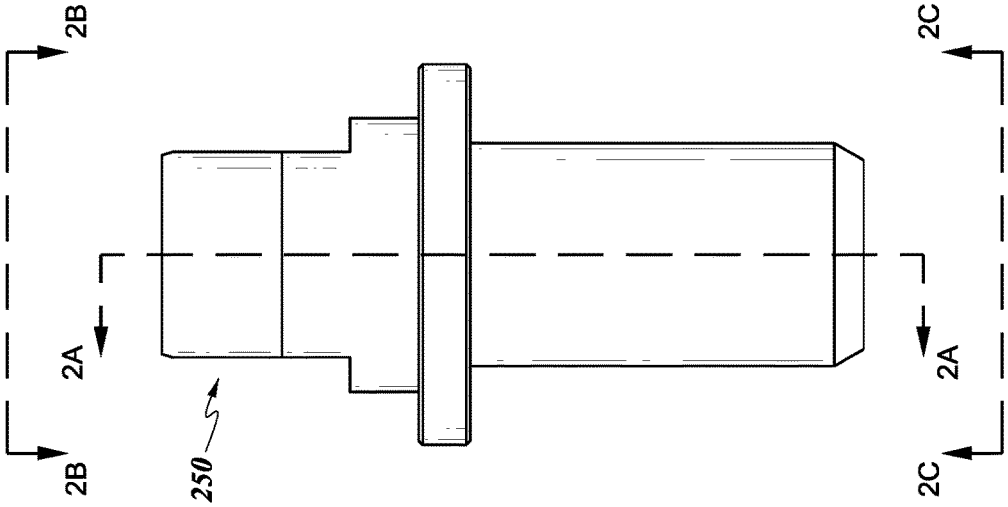
FIG. 2 is a side view of an embodiment of a connecting nut for use with the connection assembly as disclosed herein.

FIG. 2 shows a side view of a connecting nut 200. The connecting nut 200 can be capable of receiving two support rods 100, thereby facilitating the creation of one long support structure comprised of multiple support rods 100 and connecting nuts 200. FIG. 2A shows a cross-sectional view of the connecting nut 200 of FIG. 2 taken along line 2A-2A. FIG. 2B shows a top down view of the connecting nut 200 of FIG. 2. FIG. 2C shows a bottom up view of the connecting nut 200 of FIG. 2. The connecting nut 200 can be configured to receive the upper end 110 and lower end 120 of a support rod, one on each end of the connecting nut 200. The lower end 220 of the connecting nut can be configured to receive the upper end 110 of the support rod. As shown in FIG. 2A, in some embodiments the connecting nut 200 can have threading 112 at the upper end and the lower end 122. In some embodiments, the threaded portion 112 of the upper end of the support rod can mate with corresponding threading inside the lower end 220 of the connecting nut 200. Similarly, the upper end 210 of the connecting nut can be configured to receive the protrusion 121 and the lower end 120 of the support rod 100. In some embodiments, the threaded portion 122 of the lower end 120 of the support rod 100 can mate with corresponding threading inside the upper end 210 of the connecting nut 200. In some embodiments, the protrusion 121 will penetrate through an orifice 230 in the center of the connecting nut 200. This orifice 230 may be configured in a manner that increases rigidity of the assembled support rods and overall structural stability. For example, in some embodiments, the orifice 230 will be dimensioned such that there is little difference in the diameter of the orifice 230 and the diameter of the protrusion 121, and consequently little to no gap between the protrusion 121 and walls inside the orifice 230. Thus, in some embodiments, when the assembly of support rods 100 and connecting nuts 200 are subjected to stresses, tensions, torsions, or other forces, the side walls of the orifice 230 will come into contact with the protrusion 121. In some embodiments, the protrusion 121 can also serve as a guide for placing the lower end 120 of the support rod 100 into the correct location/alignment for mating with the connecting nut 200.

In some embodiments, a flange 240 may be disposed on the connecting nut 200, extending circumferentially from the body of the connecting nut 200. The flange 240 may be configured to support the connecting nut 200 and/or prevent translation or displacement of the connecting nut 200 in the vertical and/or horizontal directions. In some embodiments, the flange 240 will rest on top of the upper horizontal support 420, and in an opening formed inside the spacer 300 (discussed in more detail below).

In some embodiments, an engagement portion 250 may be disposed on the upper end 210 of the connecting nut 200. The engagement portion 250 can be shaped to engage with tools or other mechanisms for twisting and/or tightening the connecting nut 200. As shown in FIGS. 2, 2A, and 2B, the engagement portion 250 can consist of two flat, rectangular faces on opposite sides of an otherwise cylindrically or conically shaped upper portion 210 of a connecting nut.

Figure 3:
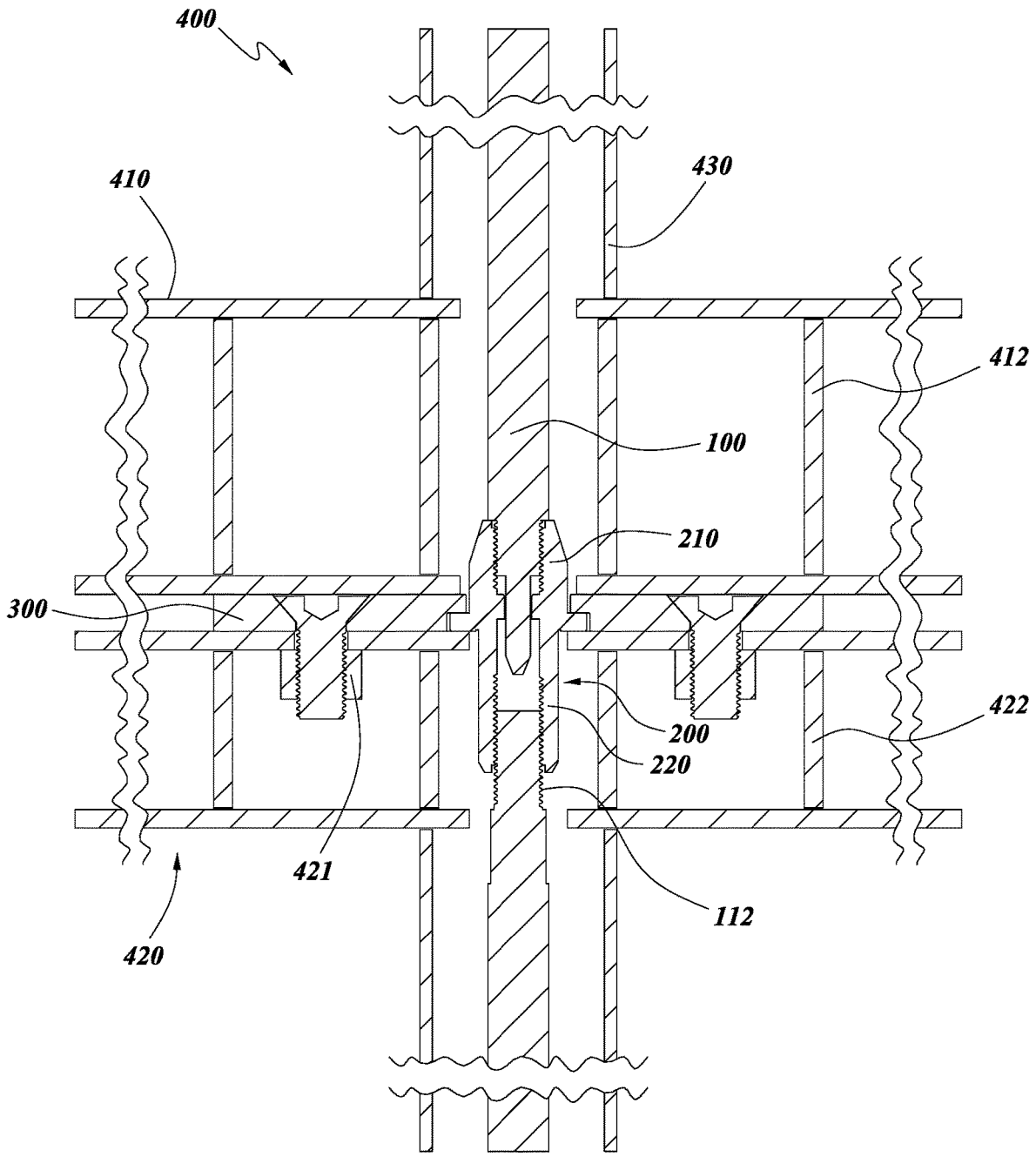
FIG. 3 is a cross-sectional view of an embodiment that includes two connection assemblies as disclosed herein in a joined configuration.
Figure 3A:
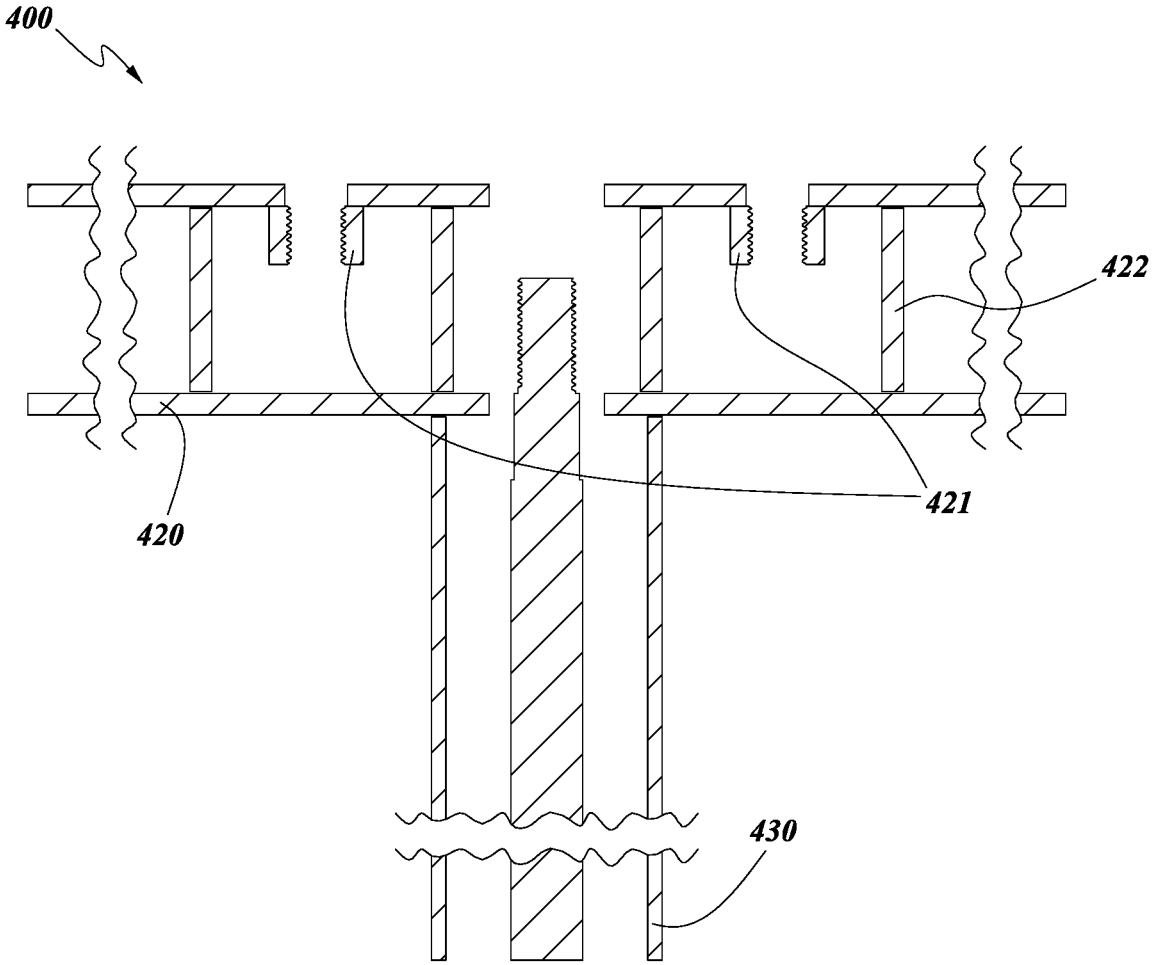
FIG. 3A is a cross-sectional view of a first step to connect the two connection assemblies.

FIG. 3A shows a front, cross-sectional view of two connection assemblies 400 in a joined configuration. Each connection assembly 400 can be part of an iterative combination of connection assemblies 400. In some embodiments, the connection assemblies 400 can be stacked on top of and connected to each other end to end such that one continuous vertical support structure can be created. Additionally, connection assemblies 400 can be attached at multiple points of a module 500 in order to facilitate the connection of modules 500 to each other and to provide structural support for the greater structure. The connection assembly 400 can be made of one or more support rods 100, one or more connecting nuts 200, and housing components. The housing components can include one or more column pieces 430 through which the support rods 100 can run. The housing components can also include one or more lower horizontal support 410 components and one or more upper horizontal support 420 components. Further, the housing components can surround, line, and/or otherwise be attached or affixed to a module 500. In some embodiments, one or more of the housing components can be used to strengthen the structural integrity and/or load bearing capabilities of the module 500. In some embodiments, the connection assembly will comprise one upper or lower support structure, one connecting nut 200, and one support rod 100 (or will share that support rod with another connection assembly 400 on the other side of the support rod 100, i.e., two connection assemblies 400 corresponding to the upper support structure 420 and lower support structure 410).

For example, in one embodiment, four upper horizontal support 420 components can run along each of the top edges of a rectangular cuboid module 500 and four lower horizontal support 410 components can run along each of the bottom edges of the same module 500. In such an embodiment, four columns 430 could also be placed at the corners of each module, connecting the lower horizontal supports 410 to the upper horizontal supports 420. Additionally, in such embodiments, columns 430 (and thus support rods 100, connecting nuts 200, and spacers 300) could also be placed at the midpoints of the long side and/or the short side of the rectangular top face of the module 500 when viewed from above. In other embodiments, columns 430 (and thus support rods 100, connecting nuts 200, and spacers 300) could also be placed at any point along the long or short side of the rectangular top face of the module 500 when viewed from above. In some embodiments, the lower horizontal supports 410 and upper horizontal supports 420 can be compromised of steel c-channel. A person of skill in the art will recognize that the upper and lower horizontal supports could be made from a variety of materials including metals, plastics, polymers, wood, or some other material. Further, other structural supports such as an H/I-beam, T-bar, Square bar, U-channel, or other supports could be used instead of a c-channel.

In some embodiments, some of the connection assemblies 400 will contain horizontal supports 410/420 which have a T-shape, when viewed from above or below. That is, some connection assemblies 400 can have horizontal supports where one linear support structure connects perpendicularly to another. FIG. 3F illustrates one embodiment where two perpendicular pieces of c-channel intersect to form a T-shaped upper and lower horizontal support. In such embodiments, one piece of linear support structure intersects with the back side of the horizontal support structures forming the T-shape (in addition to the column which intersects the horizontal support structure perpendicularly from above/below). Further, a person of skill in the art will recognize that a variety of other embodiments of the connection assembly 400 can exist depending on the size and shapes of the modules 500. In some embodiments of the connection assembly 400, the horizontal support 410/420 pieces will form 90-degree corner shapes. That is, in some embodiments, the connection assembly 400 will be L-shaped (when viewed from above) with the connecting nut 200 and support rod 100 disposed at the corner or vertex portion of the assembly 400.

In some embodiments, the upper horizontal support 420 can have nuts 421 attached to the roof of the inside of the support. These nuts 421 can allow for a screw or other fastener to be passed through a hole in the top of the upper horizontal support 420 and threaded into the nut 421 that is attached to the underside of the top of the upper horizontal support 420. In some embodiments, these fasteners can pass through the bottom of a lower horizontal support 410, a spacer 300, and the top of an upper horizontal support 420. In some embodiments, these nuts 421 will be welded to the upper horizontal support 420. A person of skill in the art will appreciate that a threaded receiving element for screws can be accomplished in a variety of ways, such as threading in the holes of the upper horizontal support 420 or some other piece of metal with threading affixed to the horizontal support. In some embodiments, fasteners can be used to lock the spacer 300 to the upper horizontal support 420, which will in turn lock the connecting nut 200 to the upper horizontal support 420 (as shown in FIG. 3, for example). Additionally, a person of skill in the art will recognize that there are other ways in which a lower horizontal support 410 can be fastened to an upper horizontal support 420, including but not limited to by welding, bonding, adhesive, or through a connecting nut 200.

The upper and lower horizontal supports can also have gusseting 412/422 or vertical slats spaced throughout the supports. These gussets may provide rigidity, support, stability, or other benefits to the structural integrity of the connection assembly and/or the greater structure it is part of. In some embodiments, either or both of the upper and lower horizontal support can have gussets. In some embodiments, the upper and/or lower horizontal supports may have reinforcement plates as shown in FIG. 3G. The reinforcement plates can be disposed on the surface of the horizontal supports 410/420. In some embodiments, the reinforcement plates can be used to provide additional rigidity, strength, or otherwise reinforce weak points in the horizontal supports where material has been removed to make holes. In some embodiments, the reinforcement plates can be shaped such that they inhibit rotation of the connecting nut 200 by being fixed rotationally to the connecting nut but dimensioned such that the reinforcement plate cannot rotate beyond some point within the horizontal support. This could be accomplished in many ways. However, in one non-limiting embodiment, the horizontal support and gussets could be arranged such that a square-shaped reinforcement plate would be inhibited from rotating past the point where it contacts a gusset, a web of channel, or some other component.

Figure 4A:
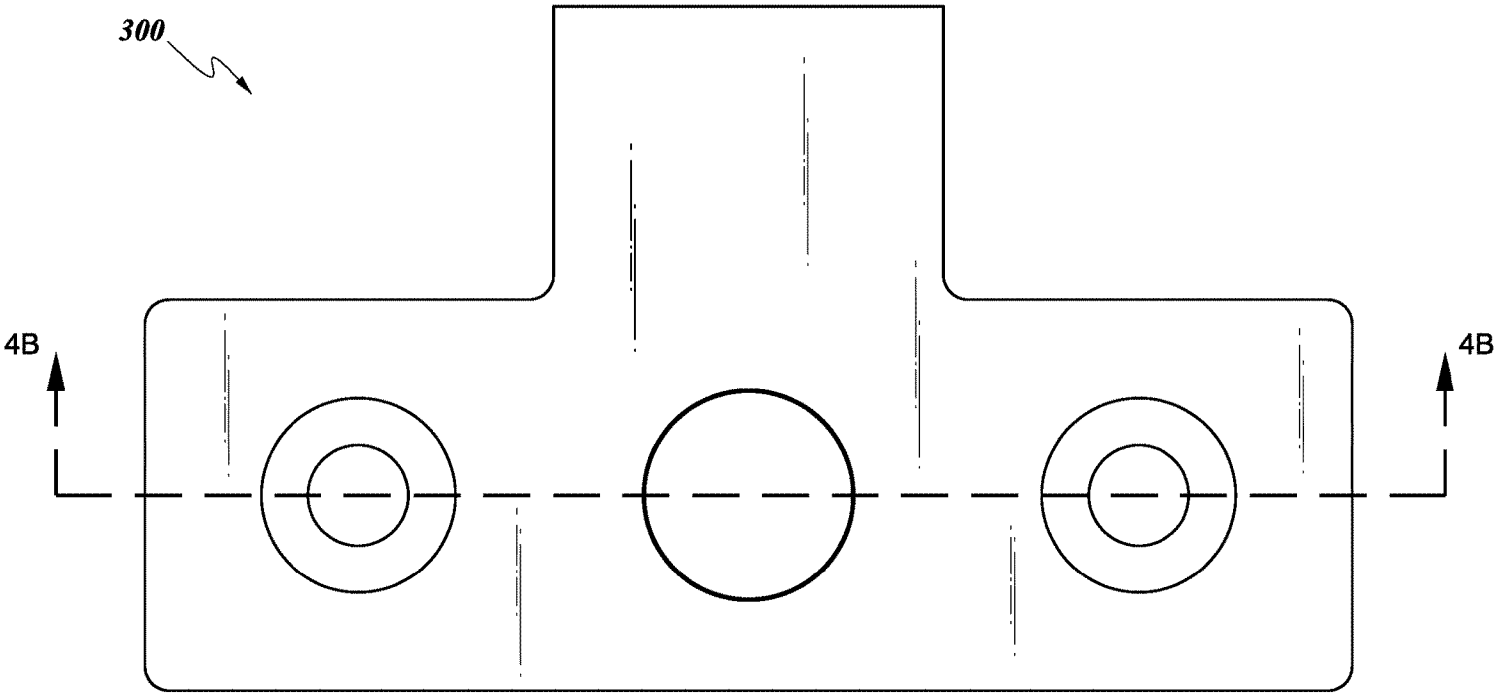
FIG. 4A is a top view of a spacer for use with a connection assembly as disclosed herein.
Figure 4B:
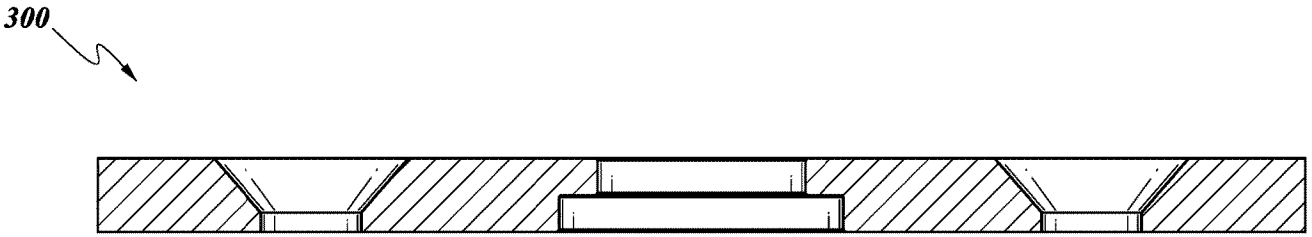
FIG. 4B is a cross-sectional view through the spacer of FIG. 4A.

FIG. 4A shows a top-down view of a spacer 300. In some embodiments, a spacer 300 may be disposed between the lower horizontal support 410 and upper horizontal support 420 as shown in FIG. 3. FIG. 4B shows a front, cross-sectional view of the spacer 300 taken through line 4B. The spacer may also have one or more holes to allow for components to pass through the spacer 300. In some embodiments, the spacer 300 will have three holes passing through the spacer 300 from top to bottom, through which the connecting nut 200 and two screws may pass through. As shown in FIG. 4B, in some embodiments, the spacer 300 can have countersunk and/or counterbored holes so that screws, bolts, the connecting bolt 200, or other fasteners could be inserted into the spacer 300, while remaining flush with or more shallow than the top surface of the spacer 300. In some embodiments, the spacer 300 may be dimensioned such that two or more connecting nuts 200 may pass through a single spacer 300. In some embodiments, two modules 500 of apartments may be connected to each other and the apartments directly above each module by one spacer 300. That is, in some embodiments, it is possible to connect two apartment modules 500 together side by side by having both modules connected with connection assemblies that utilize the same spacer. In such embodiments, one spacer 300 may have two or more connecting nuts 200 passing through the spacer 300, where each of those connecting nuts 200 is part of a connection assembly 400 attached to a separate module 500. Additionally, in some embodiments, it is possible to connect the corners of four modules 500 together by using one spacer 300. A person of skill in the art will recognize that it will be possible to connect various numbers of modules 500 together using a single spacer 400, especially where non-rectangular shaped modules 500 are utilized.

Figure 5A:
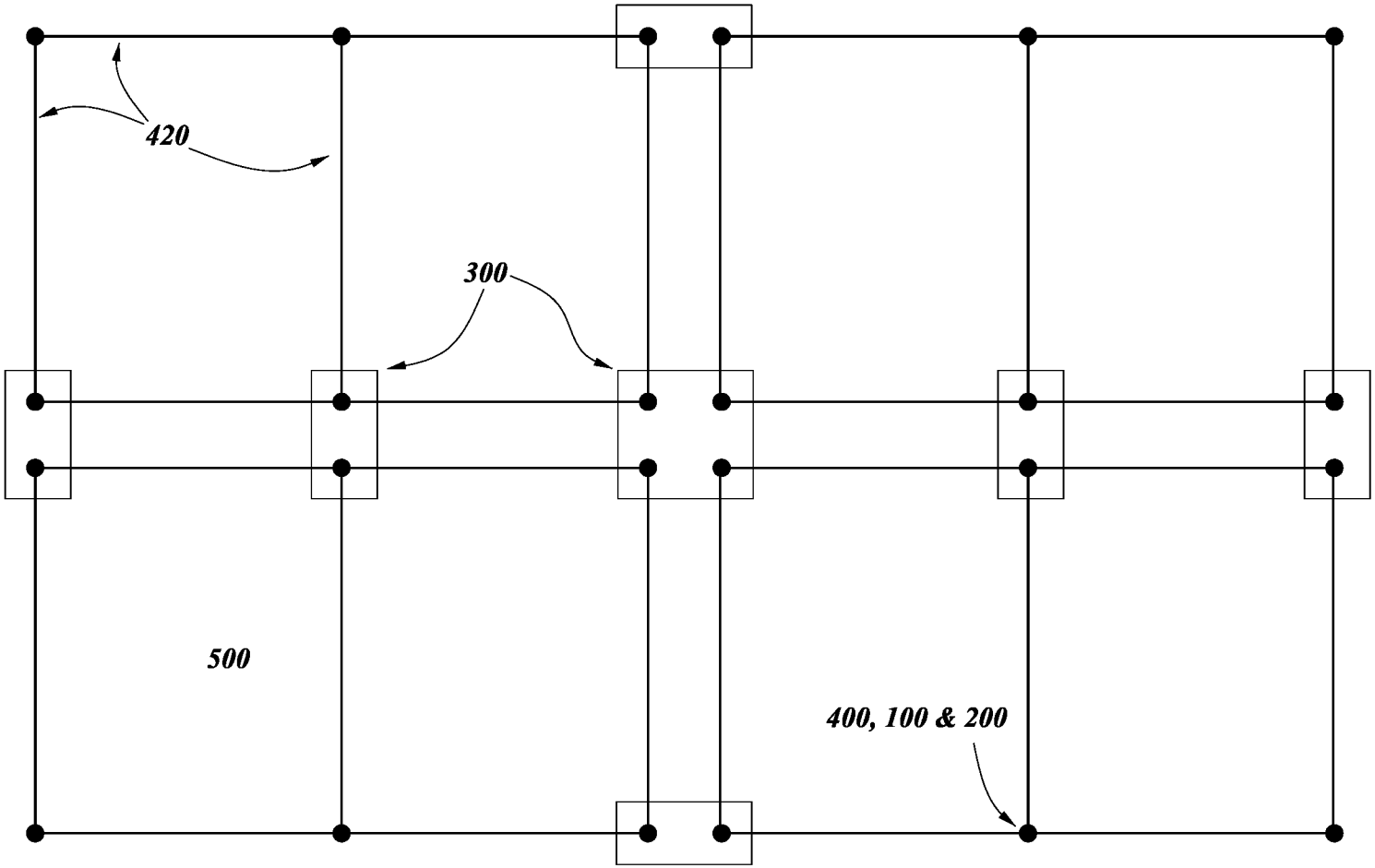
FIG. 5A is a top, plan view of a plurality of building modules forming a floor of a modular building and being connected together by a plurality of the connection assemblies of FIG. 3.

FIG. 5A illustrates one non-limiting embodiment of an arrangement of modules 500 forming a floor of a structure. In this embodiment, each module 500 has six connection assemblies 400 on the corners of the modules as well as the midpoints of the walls of the modules. Vertical members comprised of support rods 100 and connecting nuts 200 are denoted by circles on the modules in FIG. 5A. Additionally, the black boxes around the circles denote the connections made by spacers 300. As shown in FIG. 5A, one spacer 300 can be used to connect two adjacent connection assemblies 400 on two adjacent modules. FIG. 5A also shows how one spacer 300 can be used to connect four connection assemblies 400 on four modules, each one adjacent to two other modules and catty-corner to one other module 500. These modules 500 can be scaled to create matrices of floor layers of modules of any size by attaching module 500 to module 500. Additionally, structures created using these modules 500 can scale vertically to any size within reasonable physics constraints and depending on the size of the base layer used, the materials which the modules 500, foundation, and connection assemblies 400 are made out of, etc.

Figure 5B:
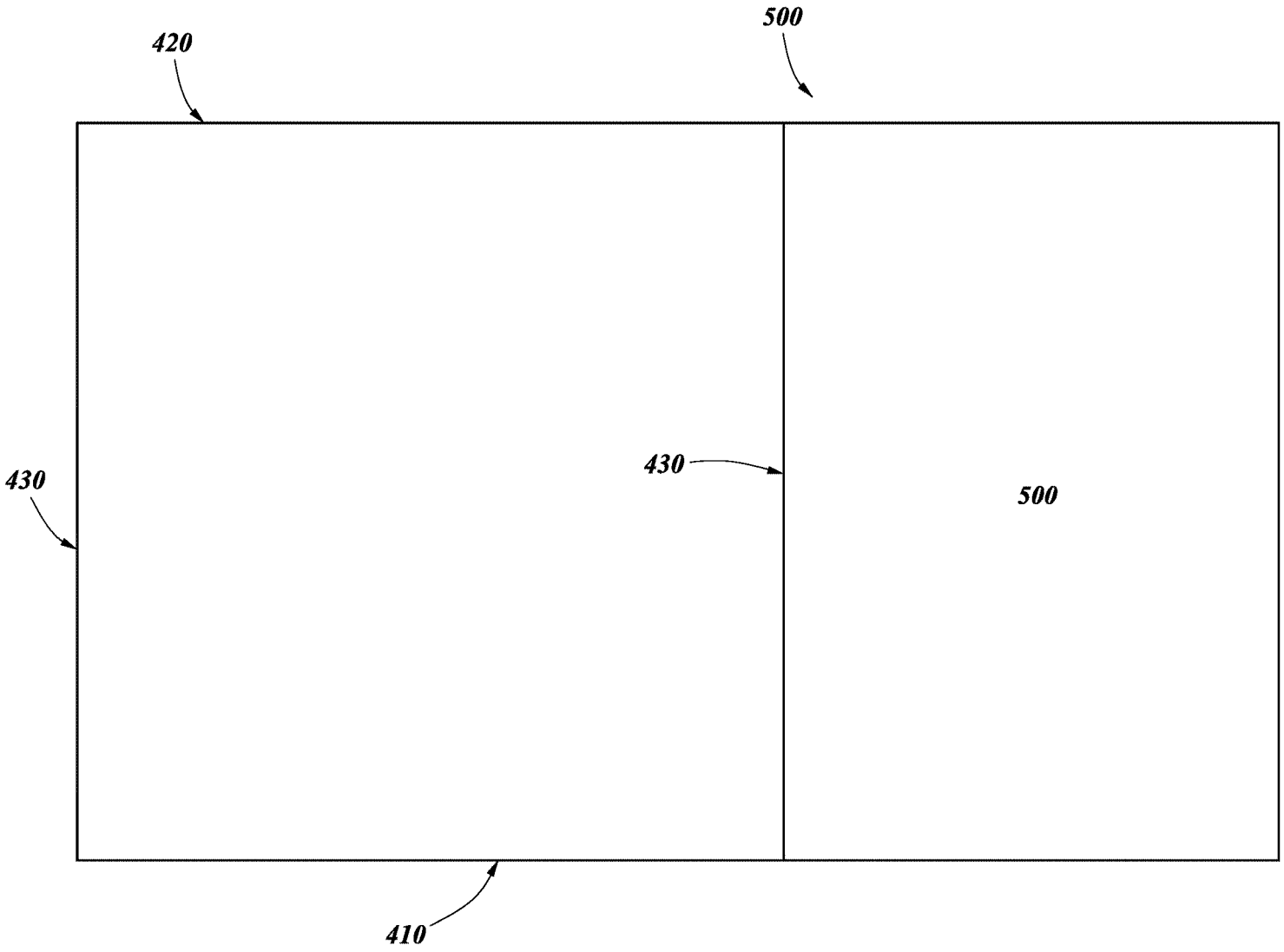
FIG. 5B is a side view of one of the plurality of building modules from FIG. 5A.

FIG. 5B illustrates a side-view of one non-limiting embodiment of a rectangular cuboid shaped module 500 with housing components attached to its frame. As shown in FIG. 5B, in some embodiments, the upper horizontal supports and lower horizontal supports frame the top and bottom edges of the module 500, respectively. In such embodiments, a module 500 can have three columns 430 on its longer side, one on each end as well as the middle. Thus, in this embodiment, there will be three connection assemblies 400 on the longer side. This configuration of channels and columns is also shown in the modules of FIG. 5A. Further, in some embodiments, hooks or lifting attachments can be fixed to the top of the connection assemblies 400. In some embodiments, the lifting attachment can be fixed to the upper end of the support rod 120. In other embodiments, the lifting attachment can be fixed to the upper end of the connecting nut 220. A person of skill in the art will recognize that the lifting attachment may be fixed to either the support rod 100 or connecting nut 200 by ways that include but are not limited to threading, welding, bonding. These lifting attachments can provide a means by which cranes or other lifting mechanisms can lift a module 500 and set it down at its desired location during the construction process. In the embodiment shown in FIG. 5A, each of the eight connection assemblies 400 marked with circles could have a lifting attachment fixed to the top of them.

The modular construction connection system described herein can be used to rapidly build structures comprised of modules 500 connected to one another. In some embodiments, the modular construction system can be used to erect buildings. In these embodiments, a site is prepared with the necessary equipment, utilities hookups, etc. to support all the requirements and functions of a building. Then, a building module 500, with lower horizontal supports 410 attached to its base and upper horizontal supports 420 attached to its top, is attached to the foundation. The foundation can be a normal foundation, a concrete pedestal or platform, or any other base upon which a building may rest. A person of skill in the art will appreciate that there are a variety of ways in which the lower horizontal supports 410 may be attached to the foundation. In some embodiments, the lower horizontal supports 410 can be attached to the foundation by threading the connecting nut 200 into a threaded receiving port in the foundation (with a spacer 300 between the horizontal support and the foundation in some embodiments).

Next, the support rod 100 can be inserted into the connection assembly so that the lower end of the support rod 120 can mate with the connecting nut 200 disposed on the lower horizontal support 410. In some embodiments, the support rod 100 can be threaded into the connecting nut 200 disposed on the lower horizontal support 410 and tightened by connecting a wrench or other tightening tool to the upper portion 110 of the support rod 100, shaped to interface with a tightening tool 113. Then, another connecting nut 200 is attached to the upper end of the support rod 110. The connecting nut 200 may be attached by threading on the upper end of the support rod 112 and inside the connecting nut. Additionally, a wrench or other tightening tool may interface with the engagement portion 250 of the upper portion of the connecting nut 200 in order to turn and tighten the connecting nut 200.

Next, a spacer 300 can be placed on top of the top of the upper horizontal support 420. The spacer 300 can also fit over the connecting nut 200, with a hole so that the spacer 300 can pass over and surround the connecting nut. Two or more screws can then be inserted through the spacer 300 and threaded into the welded nuts 421. Finally, a lower horizontal support (connected to another module) can be placed on top of the spacer 400, connecting nut 200, and screws. The connecting nut 200 can pass through a hole in the lower horizontal support 421 and thus be capable of receiving another support rod 100 inside the housing of the next connection assembly 400.

Figure 3B:
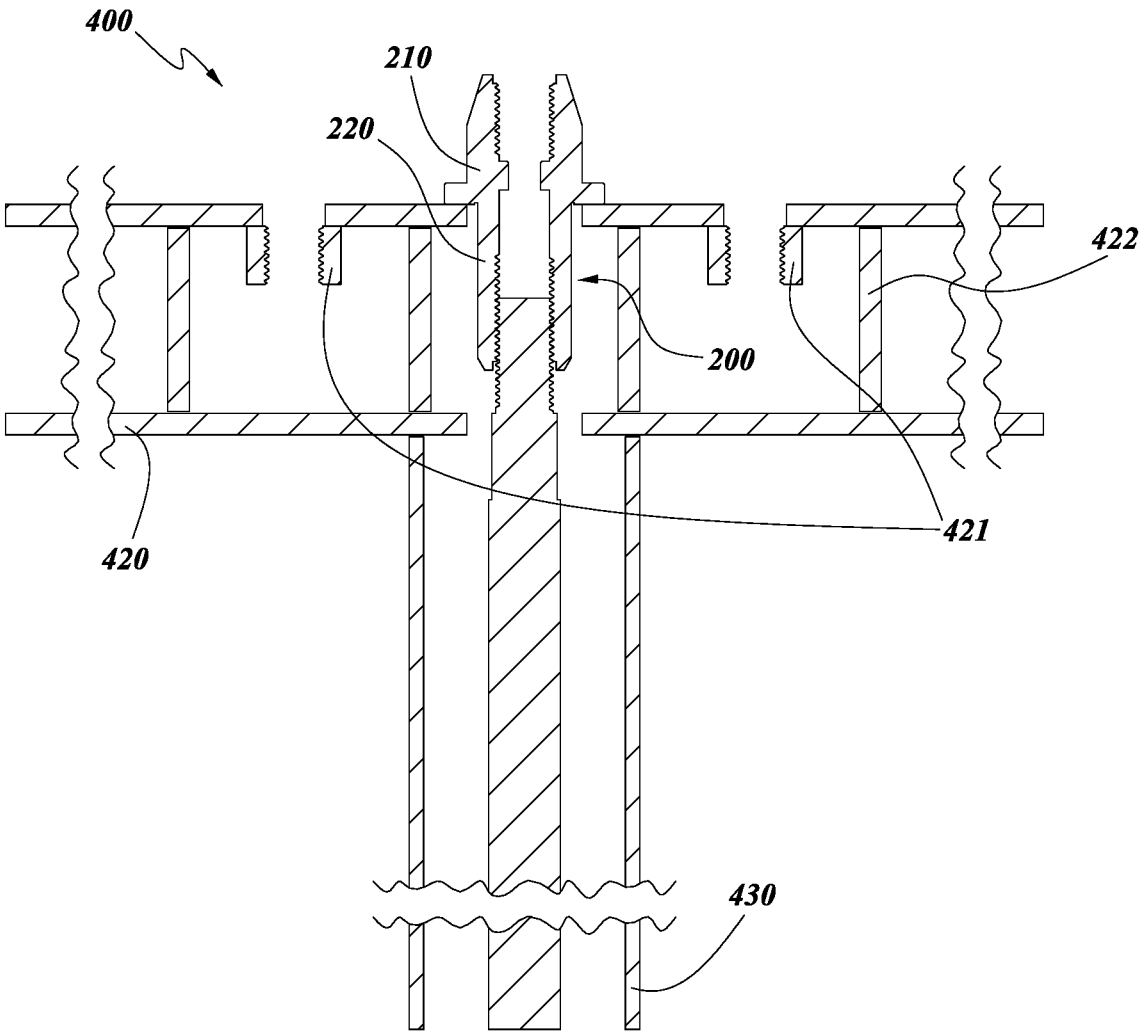
FIG. 3B is a cross-sectional view of a second step to connect the two connection assemblies.
Figure 3C:
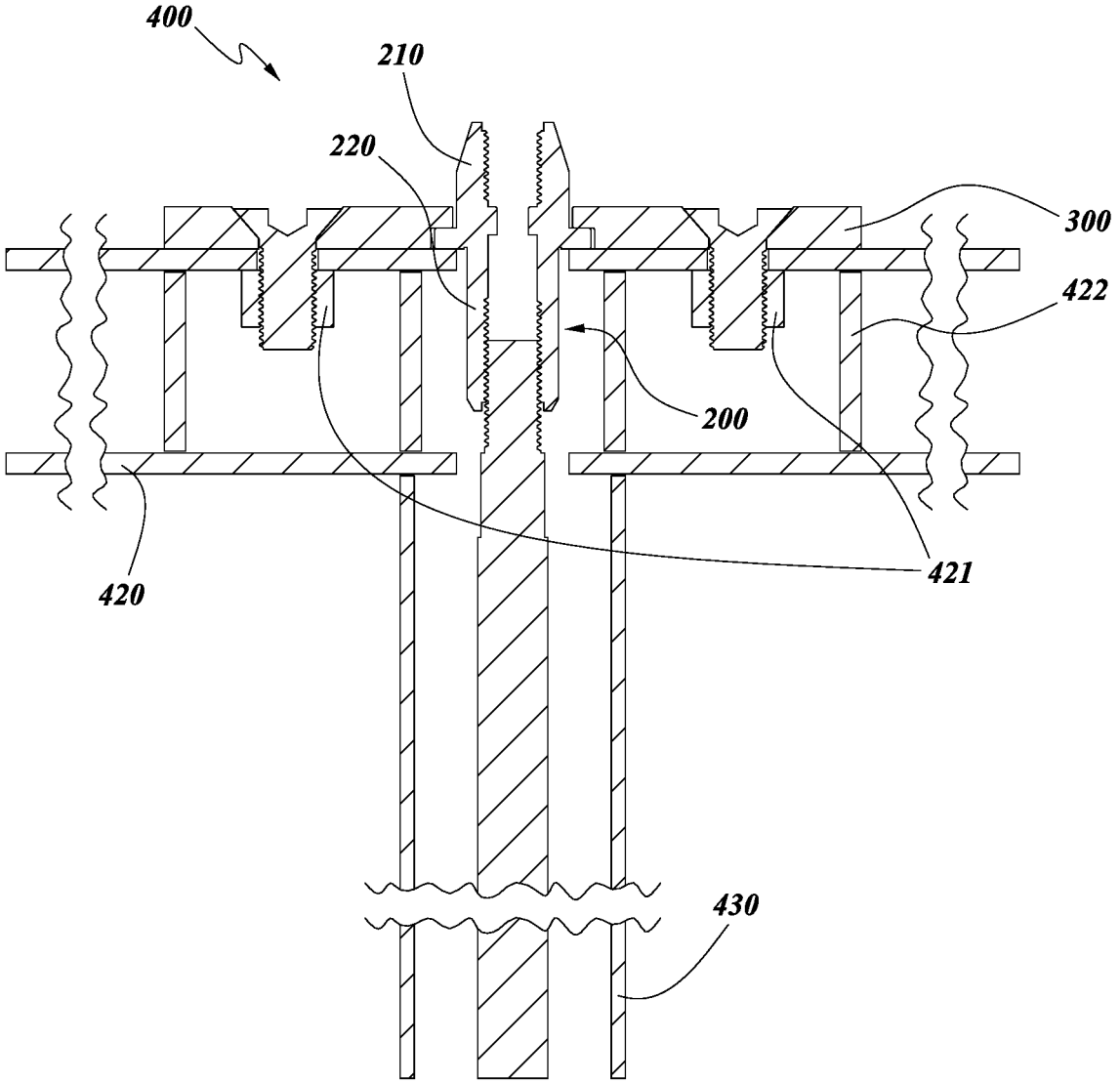
FIG. 3C is a cross-sectional view of a third step to connect the two connection assemblies.
Figure 3D:
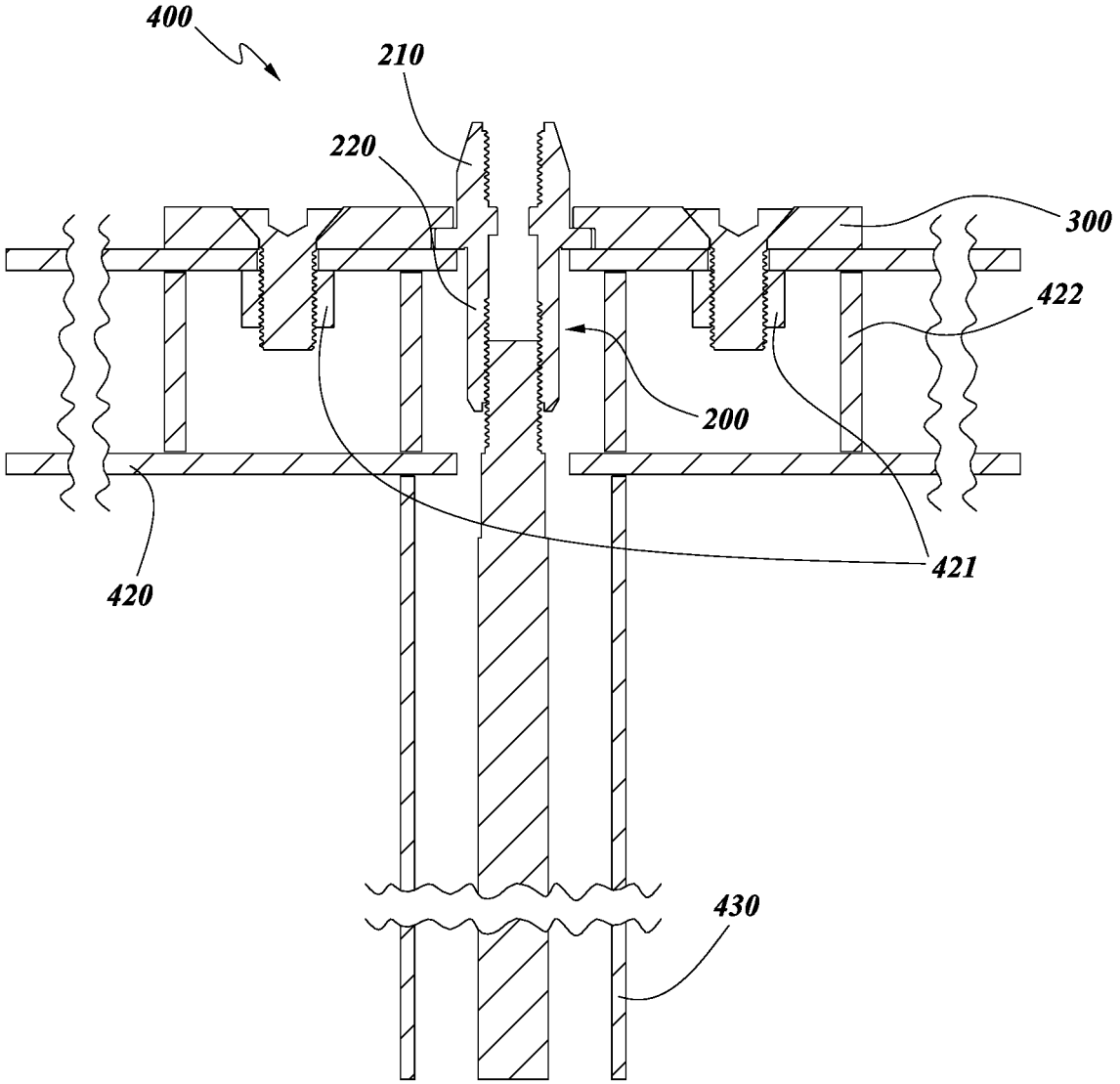
FIG. 3D is a cross-sectional view of a fourth step to connect the connection assemblies.
Figure 3E:
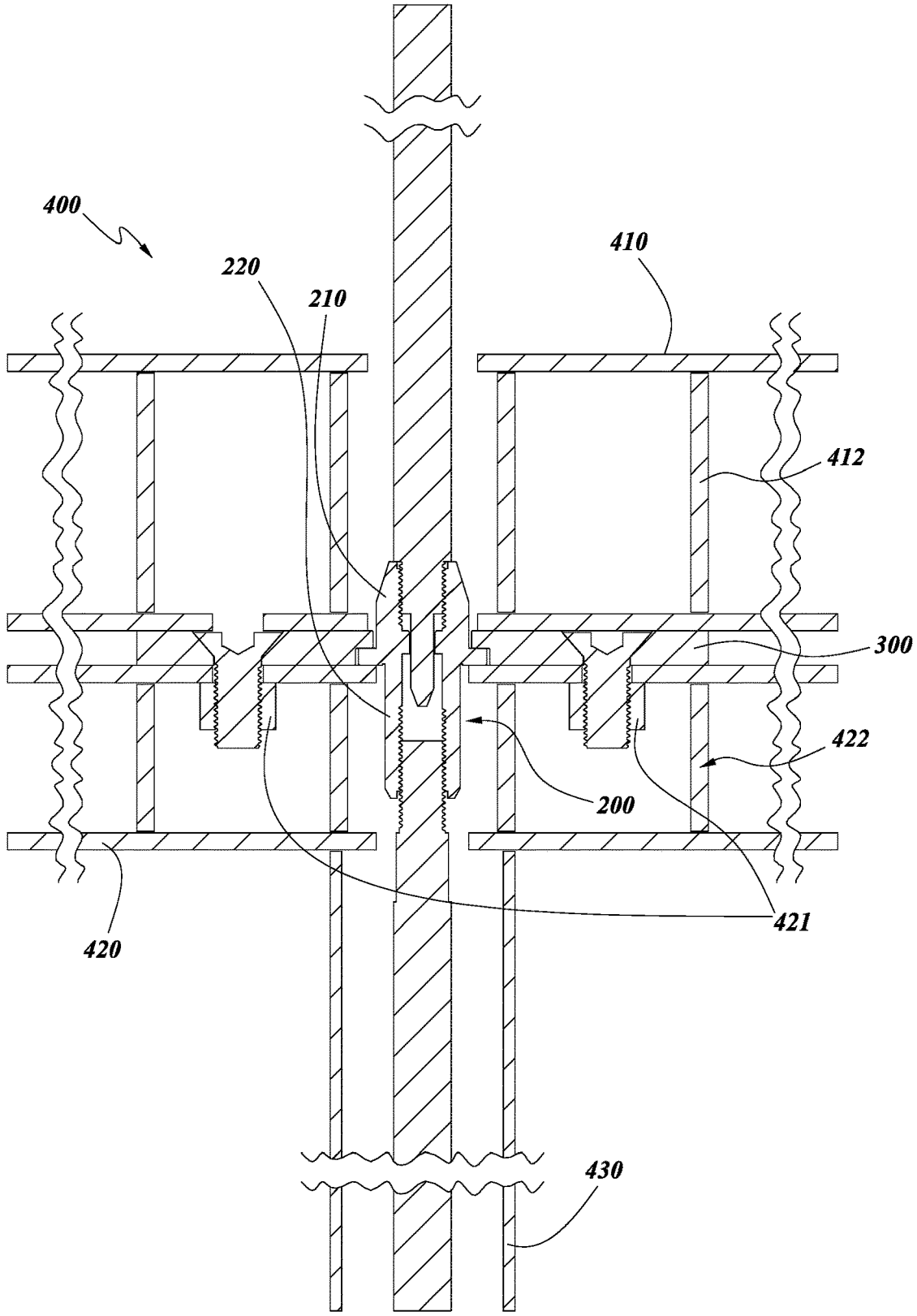
FIG. 3E is a cross-sectional view of a final step joining the connection assemblies to achieve the configuration shown in FIG. 3.
Figure 3F:
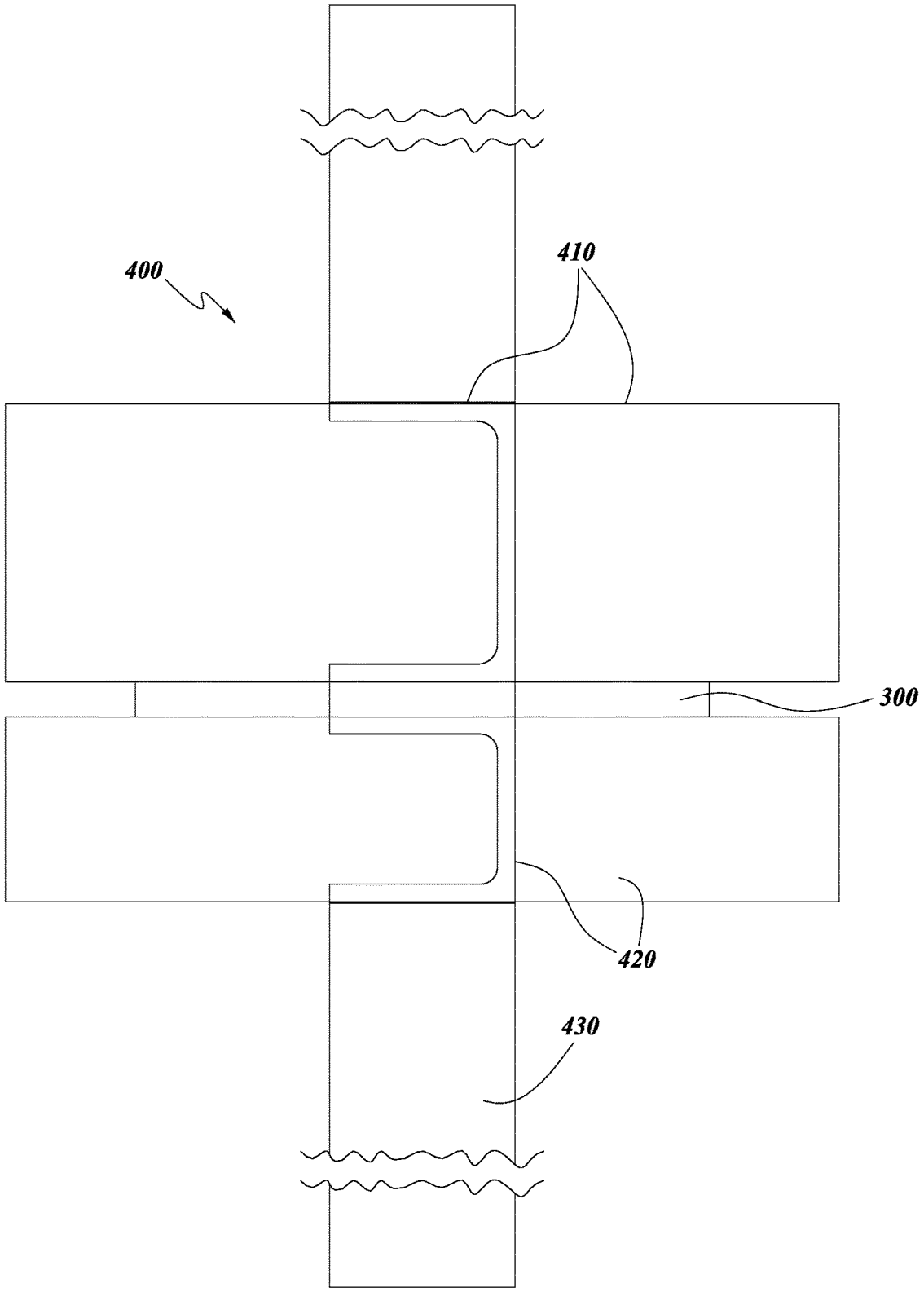
FIG. 3F is a backside view of the embodiment shown in FIG. 3.

FIGS. 3A-3E illustrate the process by which the connection assembly 400 of one module 500 is connected to the connection assembly 400 of another module 500. FIG. 3A shows an upper horizontal support structure 420 with a connecting rod 100 inside the column piece 430. FIG. 3B then shows a connecting nut 200 having been threaded onto the support 100. As shown in FIG. 3B, the flange 240 of the connecting nut 200 rests on the upper surface of the lower horizontal support 420. FIG. 3C shows a spacer 300 having been placed over the connecting nut 200 and fasteners screwed into the welded nuts 421. As shown in FIG. 3C, in some embodiments the spacer 300 can be placed over the connecting nut 200 and securing in place by screws inserted into counter-sunk holes in the spacer 300. FIG. 3D shows a second module 500 having been placed on top of the first module 500. As shown in FIG. 3D, the lower horizontal support structure 410 from the second module is placed over the spacer 300 and connecting nut 200. FIG. 3E shows a support rod 100 having been threaded into the upper end 210 of the connecting nut. In some embodiments, the support rod 100 will have been inserted through a hole in the upper horizontal support structure 420 of the second module 500, through the column piece 430, and into the lower horizontal support structure 410 of the second module.

One of skill in the art will recognize that this process can be used to build structures by stacking module 500 on top of module 500 to create a tall structure with the width and length of a single module. One of skill in the art will also recognize that a rectangular base floor can be formed wherein modules are arranged adjacent to each other to form bases comprised of two by two modules, two by three modules, three by three modules, and so on. Additionally, the base can be arranged to form irregular shapes. The base can also comprise modules of varying sizes and shapes, including irregular shapes.

One of skill in the art will recognize that buildings can be created by stacking floors of modules on top of each other, and securing those modules to the modules directly above and below them using connection assemblies 400 and the method described above. Additionally, one of skill in the art will recognize that buildings can be created also by using the method described above of connecting multiple modules together on the horizontal axes to form a floor of modules by attaching the tops of connection assemblies 400 to each other using a single spacer 300 to connect multiple modules 500 together. In this way, prefabricated building modules 500 can be produced off-site and transported to a construction site ready to assemble. Then, those modules 500 can be lifted by a crane and connected together to form floors of modules 500 which can be stacked on top of each other to produce a full building of modules 500. In some embodiments of these modular buildings, each portion of the building can be created as a module. That is, for example in apartment buildings, some modules 500 could be apartment units, while other modules could be elevator and stairway shafts or other components of an apartment structure. In some embodiments, the building modules 500 can include hallway portions combined with apartments so that when building modules 500 are connected to each other, a hallway is formed and there is no need for separate hallway modules. In some embodiments, the building modules 500 can contain balconies and/or stairwells. A person of skill in the art will recognize that the modules 500 described herein are inherently versatile and can be composed of many different components depending on the type of and structure of the building which they are used to construct.

In one non-limiting embodiment, this method and system can be used to build commercial apartment buildings. However, a person of skill in the art will recognize that the disclosed system and method can be used to construct buildings for virtually any purpose. That is to say, one of skill in the art will recognize that in addition to apartment buildings, the disclosed modular construction system and method may be used to build other types of buildings including, but not limited to offices, hotels, prisons, senior housing, and dormitories. Because the disclosed building modules are so versatile and composable, they can be fabricated as virtually any portion of a building. These building modules 500 can be fabricated as apartment rooms, stairwells, jail cells, roof units, basement units, elevator shafts, HVAC or electrical rooms, in addition to many others.

What is claimed is:

1. A connection system comprising:

one or more lower horizontal support structures;

one or more upper horizontal support structures;

one or more column supports connecting the one or more lower horizontal support structures to the one or more upper horizontal support structures and forming a building floor between the lower and upper horizontal support structures;

one or more support rods, each having an upper end and lower end on opposite longitudinal poles of each rod;

one or more connecting nuts, each having openings on both longitudinal ends, and each having a flange disposed circumferentially around a portion of the nut between both longitudinal ends; and a spacer having one or more holes disposed through it from an upper surface of the spacer through the lower surface of the spacer, the spacer being sized and shaped to fit between the top of one of the upper horizontal support structures and the bottom of an adjacent lower horizontal support structure, wherein the spacer and the horizontal support structures are configured to receive the connecting nut such that one of the longitudinal ends of the connecting nut is disposed in one of the upper horizontal support structures while the other longitudinal end of the connecting nut is disposed in the adjacent lower horizontal support structure, wherein both the upper end and the lower end of the one or more support rods are configured to attach to a connecting nut;

wherein each of the one or more support rods is disposed within one of the one or more column supports and spans the length between the lower horizontal support structures and the upper horizontal support structures.

2. The system of claim 1, further comprising a module, wherein the one or more upper horizontal support structures surround an upper edge of the module, and the one or more lower horizontal support structures surround a lower edge of the module.

3. The system of claim 2, wherein the module is a prefabricated module.

4. The system of claim 3, wherein the module is a prefabricated section of an apartment building.

5. The system of claim 4, wherein the module is a prefabricated apartment.

6. The system of claim 3, wherein the module is a prefabricated section of condominium building.

7. The system of claim 2, wherein the module comprises one or more sets of stairs.

8. The system of claim 2, wherein the module comprises one or more elevator shafts.

9. The system of claim 2, wherein the module comprises a hallway.

10. The system of claim 2, wherein the module comprises an apartment and a hallway.

11. The system of claim 2, wherein the module comprises an apartment and a staircase.

* * * * *